US009056220B2

(12) United States Patent
Richards et al.

(10) Patent No.: US 9,056,220 B2
(45) Date of Patent: Jun. 16, 2015

(54) AQUATIC EQUILIBRIUM CYCLE

(76) Inventors: Erik Richards, Kingston, NY (US); Andrew Howansky, Kahului, HI (US)

( * ) Notice: Subject to any disclaimer, the term of this patent is extended or adjusted under 35 U.S.C. 154(b) by 308 days.

(21) Appl. No.: 13/066,831

(22) Filed: Apr. 25, 2011

(65) Prior Publication Data

US 2011/0275487 A1 Nov. 10, 2011

Related U.S. Application Data

(60) Provisional application No. 61/327,706, filed on Apr. 25, 2010.

(51) Int. Cl.

| | |
|---|---|
| ***A63B 22/06*** | (2006.01) |
| ***A63B 21/008*** | (2006.01) |
| ***A63B 26/00*** | (2006.01) |
| ***A63B 35/00*** | (2006.01) |
| ***B63B 35/74*** | (2006.01) |
| ***B63H 1/32*** | (2006.01) |
| ***B63H 16/20*** | (2006.01) |
| ***A63B 21/00*** | (2006.01) |
| *A63B 22/00* | (2006.01) |

(52) U.S. Cl.

CPC ..... *A63B 22/0605* (2013.01); *A63B 21/0084* (2013.01); *A63B 22/0002* (2013.01); *A63B 22/0012* (2013.01); *A63B 22/0046* (2013.01); *A63B 26/003* (2013.01); *A63B 35/00* (2013.01); *A63B 2208/03* (2013.01); *A63B 2210/50* (2013.01); *A63B 2225/605* (2013.01); *B63B 35/74* (2013.01); *B63H 1/32* (2013.01); *B63H 16/20* (2013.01); *B63H 2016/202* (2013.01); *A63B 21/00076* (2013.01); *A63B 21/00069* (2013.01)

(58) Field of Classification Search

CPC ..... A63B 22/06; A63B 22/0605; A63B 22/0665; A63B 22/0694; A63B 22/08

USPC ..... 482/57, 113, 58, 111, 129

See application file for complete search history.

(56) References Cited

U.S. PATENT DOCUMENTS

| | | | | | |
|---|---|---|---|---|---|
| 1,192,650 | A | * | 7/1916 | Leitner | 441/60 |
| 1,318,879 | A | * | 10/1919 | Jones | 440/31 |
| 1,332,634 | A | * | 3/1920 | Piateski | 440/31 |
| 1,457,908 | A | * | 6/1923 | Kupsche | 440/31 |
| 1,521,487 | A | * | 12/1924 | Turner | 482/132 |
| 1,728,103 | A | * | 9/1929 | Chaligne | 114/283 |

(Continued)

OTHER PUBLICATIONS

Dale M Webber Jill P Aitken Ronald K O'Dor Costs of Locomotion Vertic Dynamics of Cephalopods Fish Physiological Biochemical Zoology 736:651-662 2000.*

(Continued)

*Primary Examiner* — Loan H Thanh
*Assistant Examiner* — Rae Fischer
(74) *Attorney, Agent, or Firm* — Richard K Thomson

(57) ABSTRACT

Several embodiment of an exercycle which is suspended by floatation devices just below the surface of the water, requires the user to exercise both upper and lower body portions to work the cycle while maintaining balance in the water. The aquatic equilibrium cycle can be used for muscle toning, physical therapy or competition. Some embodiments employ a foot pedal having hinged wings which produce an octopus-type propulsion to move the cycle in a forward direction. Some embodiments allow the adjustment of the magnitude of floatation force to accommodate the body size of the particular end user.

1 Claim, 14 Drawing Sheets

(56) References Cited

U.S. PATENT DOCUMENTS

| | | | | | |
|---|---|---|---|---|---|
| 2,317,905 | A | * | 4/1943 | Galkin | 440/26 |
| 2,792,577 | A | * | 5/1957 | Boyers | 441/60 |
| 2,898,611 | A | * | 8/1959 | Mooney | 441/60 |
| 3,129,707 | A | * | 4/1964 | Becker et al. | 128/205.24 |
| 3,640,239 | A | * | 2/1972 | Petroskey | 440/12 |
| 3,844,246 | A | * | 10/1974 | Locher | 440/12.53 |
| 3,922,988 | A | * | 12/1975 | Caton et al. | 114/165 |
| 4,092,945 | A | * | 6/1978 | Ankert et al. | 440/12.55 |
| 4,229,001 | A | * | 10/1980 | Roman | 482/79 |
| 4,241,688 | A | * | 12/1980 | Mansolill et al. | 482/58 |
| 4,434,981 | A | * | 3/1984 | Norton | 482/70 |
| 4,576,580 | A | * | 3/1986 | Gulko | 440/21 |
| 4,759,544 | A | * | 7/1988 | Diaz | 482/111 |
| 4,828,522 | A | * | 5/1989 | Santos | 441/129 |
| 5,116,295 | A | * | 5/1992 | Dunn et al. | 482/53 |
| 5,626,501 | A | * | 5/1997 | He | 440/30 |
| 5,643,155 | A | * | 7/1997 | Kallassy | 482/111 |
| 7,425,190 | B2 | * | 9/2008 | Kolarick et al. | 482/111 |
| 7,736,205 | B2 | * | 6/2010 | Krah | 440/25 |
| 7,794,364 | B2 | * | 9/2010 | Killgore et al. | 482/55 |
| 8,167,667 | B2 | * | 5/2012 | Sturm | 440/21 |

OTHER PUBLICATIONS

Dale M. Webber, Jill P. Aitken and Ronald K. O'Dor, Costs of Locomotion and Vertic Dynamics of Cephalopods and Fish, Physiological and Biochemical Zoology 73(6):651-662, 2000.*

* cited by examiner

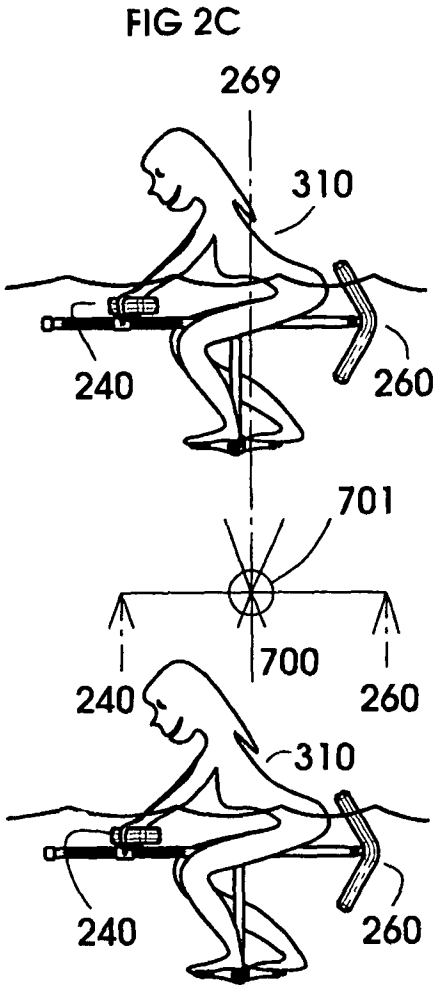
FIG 2C
FIG 2D
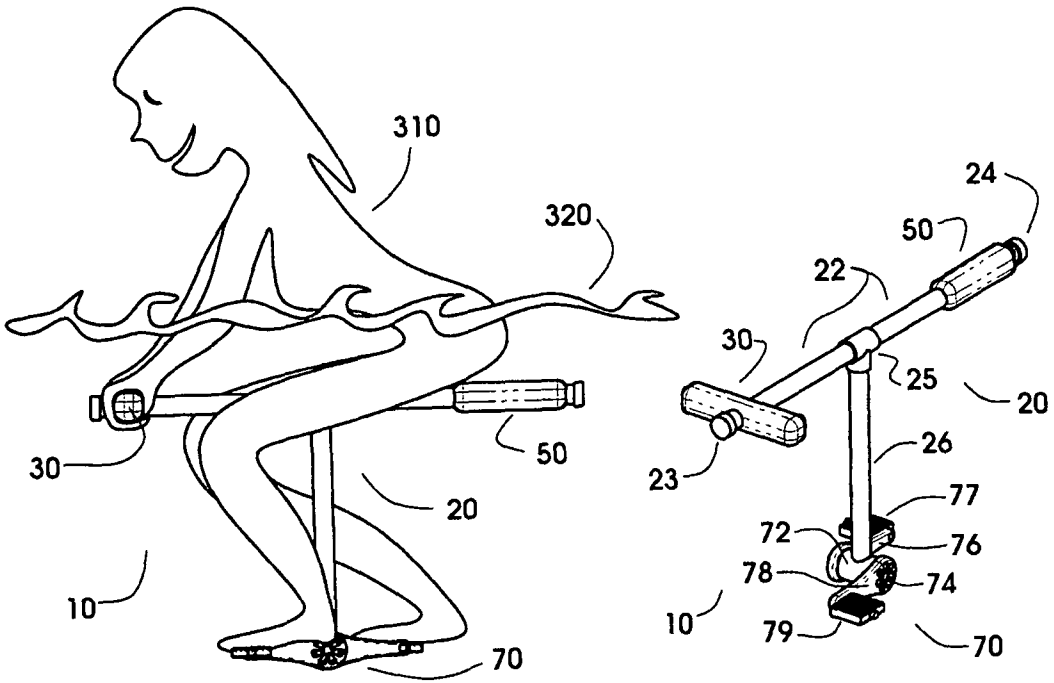
FIG. 1B
FIG. 1A

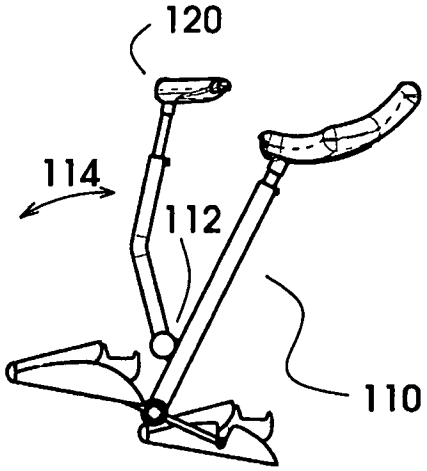
FIG 4B
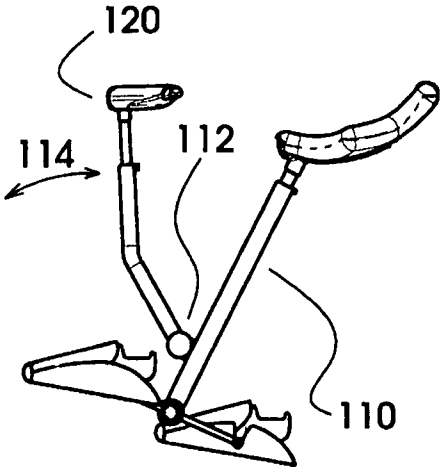
FIG 4C
FIG 4D
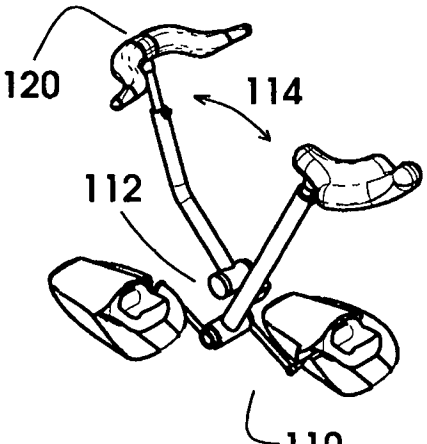
FIG 4A
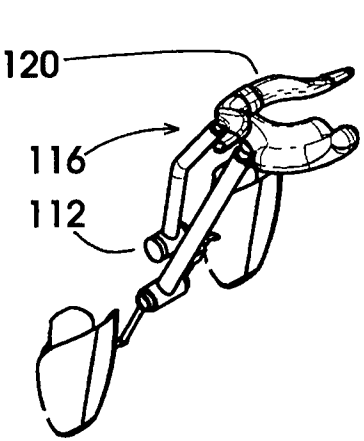
FIG 4F
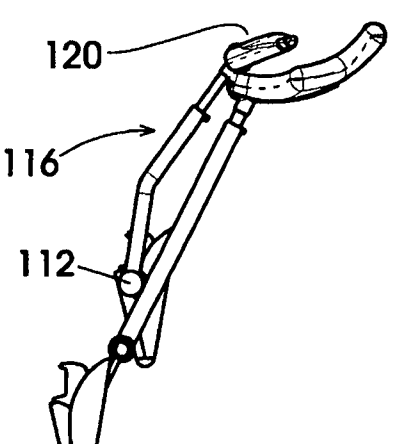
FIG 4E

AQUATIC EQUILIBRIUM CYCLE

This invention relates to a partially submerged bicycle-like device that requires balancing in the water while cycling, creating potential forward movement for therapeutic rehabilitation, physical exercise, and/or sport competition. Applicant claims the benefit of provisional Patent appl. Ser. No. 61/327,706 filed Apr. 25, 2010.

BACKGROUND OF INVENTION

Utilizing water for exercise is a common theme for therapeutic purposes as well as for exercise and water sports. Combining the balancing and pedaling action of riding a bicycle on land without the harsh impact can be attained by creating a device that provides these features specifically designed for an aquatic environment. The Aquatic Equilibrium Cycle addresses the issue of providing low impact water exercise with the need for the end user to balance their body while paddling. This creates a total body workout that targets the legs through the pedaling motion and targets the upper body through the need for maintaining balance, while relieving the stress typically associated with riding a bike on land.

The Aquatic Equilibrium Cycle is unique in that it provides the paddling movement in varying degrees of difficulty by the use of an open and close cupping action on the pedal system modeled after the motion of an octopus' movement. This opening occurs when the end user peddles. As the pedal makes its motion to the back, a cup shape is created and when pushing to the front closes to allow for easier movement. How far the cupping action is allowed to open can be controlled by a preset device before entering the water or could be designed to change on the fly according to the end user's desires. The Aquatic Equilibrium Cycle also utilizes a unique front and rear flotation support that creates float but does not stabilize the entire unit requiring the end user to work at maintaining balance while in use.

The Water Bicycle as referred to in U.S. Pat. No. 1,332,634 to Piateski (1920) is shown with a propulsion unit in the form of a propeller and pontoon like floating apparatuses that allow the end user to be submerged in the water but keep the device supported at the surface of the water. Although the Water Bicycle provides movement, the pedaling force required by the end user is constant and the need to balance is eliminated by the pontoon like flotation.

The most up to date form of a water bicycle can be found in the U.S. Pat. No. 7,425,190 to Kolarick (2008), entitled, the "Exercise Kit for Personal Flotation Device". This unit takes a common noodle style flotation device and provides a modification kit to allow an end user to utilize the noodle as a bicycle like device. After the kit is applied to a noodle, the result is two interfaces for movement, one for the arms and one for the legs both in rotational motion. In order for an end user to properly implement the Kolarick patent, a common flotation noodle must be acquired and then modified. The Kolarick patent is a unique approach to providing a full exercise solution but does so at the expense of the end user in terms of assembly and the need for additional components.

The purpose of the Aquatic Equilibrium Cycle is to provide a complete final product solution, not a kit to modify an existing product. The main goal in the design of the Aquatic Equilibrium Cycle was to provide a device that mimics a road bicycle with the advantages of water low impact usage while incorporating unique features that provide advantages over placing a road bike in the water with floats on it. The Aquatic Equilibrium Cycle accomplishes the task in a sleek, simple invention that provides variable resistance and propulsion as well as the need to balance in the water. Having a noodle and a modification kit does not accomplish this task. The simplest form of implementing a bicycle in water is demonstrated by U.S. Pat. No. 5,626,501, issued to Xiaohai He (1997) entitled the Pontoon Water Bike. In this design the entire bicycle is held outside and above the water by a set of pontoons. The pontoons are in the water but the bicycle and the person on it are held above the water and the bicycle is used to create propulsion in the water by means of a water hub that pushes the unit forward.

The Pontoon Water Bike provides exercise for the end user but does not provide the low impact of being in the water. The definition of a pontoon is significant and in the invention itself, "pontoons support a superstructure above water on which ride both cargo and means for locomotion". This is the key to the Pontoon Water Bike, but in the case of the Aquatic Equilibrium Cycle, it is important that most of the device including the person riding it, is held below the water, not above (except for the rider's head and, in some cases, arms, which are above water level). The unique front and rear floatation supports may or may not protrude out of the water and are at a different level for each rider, thus creating the need for balance while pedaling the unit. There are many devices that utilize the old fashioned pontoon like design that hold the entire unit above water. The Aquatic Equilibrium Cycle must not be held completely out of the water but must be held partially submerged to create an upward push that requires the end user to maintain balance. The need to create equilibrium in balance is a requirement for the Aquatic Equilibrium Cycle to function properly, making it unique in general and particularly as relating to pontoon-like water bike devices. The need for a device that is partially submerged in the water and requires the end user to utilize the ability to balance in all directions, as well as harness the power of pedaling to create motion, is essential for a challenge as well as a full workout.

U.S. Pat. No. 4,828,522 to Santos (1989) discloses a similar method of a submerged water bike exerciser by means of inflatable flotation sections that support a person's shoulders and (in some orientations) arms above the water. The submerged action is important for low impact and the flotation sections fully support the end user so they do not have to worry about self balancing in the water. The Santos patent has flotation supports that are inflatable and essential to the design and functionality. The Aquatic Equilibrium Cycle does not require the need for the flotation mechanism to be inflatable. In fact the Santos patent puts more of a burden on the end user by requiring additional preparation work before even entering the water, by having to inflate the supports.

The other limitation of the Santos Aquatic Exerciser is the fact that the flotation mechanisms hold the entire unit upright in the water without the need for the end user to ever worry about creating balance. In one respect this is good for ease of use, but for a full workout of the muscles and the need for a challenge, the desire to create balance is essential for a full rounded effect in emulating a road like bicycle ride in the water. The Aquatic Equilibrium Cycle is unique in that the mechanism for floatation, the front and rear floatation supports are partially submerged or submerged just below the surface which forces the need for the end user to have to maintain a constant workout to stay upright which is important for therapeutic, exercise and sport workouts. The flotation supports also incorporate a unique flotation adjustment that allows each user to adjust the device to the proper equilibrium level in reference to the water line that is appropriate for their weight, size and body density. The advantage of submerging most of the end user in the water is that the flotation required to support their weight is greatly reduced. This allows for the frame structure and the flotation supports to be that of a smaller and adjustable nature.

U.S. Pat. No. 1,332,634 to Piateski (1920) discloses a water bicycle propelled by the use of a propeller shaft and propeller to create movement in the water. There are many human propelled human powered vehicles for the water that utilize a propeller system and the propeller system is essential to the operation of these human powered water vehicles. The Aquatic Equilibrium Cycle does not use a propeller system at all and in fact utilizes a unique motion system discussed further in this application based on the motion of an octopus.

U.S. Pat. No. 2,317,905 to Galkin (1941) discloses a device for paddling in the water utilizing a paddle wheel. Also the unit is suspended and submerged providing steady stability without the need for personal balance while in the water. The paddle wheel is a typical design similar to a water wheel in which the water is caught in pockets of a wheel that create motion. These pockets are of a static nature and are not adjustable unless the water wheel is replaced with a larger water wheel creating greater resistance. The Aquatic Equilibrium Cycle utilizes a new technology that emulates the movement of an octopus in which the pedal system has a hinged device consisting of two scoop shaped wings that when pushed forward close and when pushed backward become opened by means of the water becoming trapped inside them as they open causing forward movement. This is unique in that it provides variable resistance as well as propulsion that can be adjusted by how far open the wings are allowed to swing, again contributing to the exercise or workout or competitive challenge.

The Galkin device provides constant stability in the water whereas the ability to have to create balance while riding the Aquatic Equilibrium Cycle again sets it apart from the Galkin Water Cycle.

U.S. Pat. No. 4,576,580 to Gulko (1986) discloses a device for paddling in the water utilizing a horizontal paddle board for each foot to create motion. The paddle board system is an adequate form of propulsion but is a much different application in comparison to the Aquatic Equilibrium Cycle which is powered by simulating an octopus' motion. The paddle board system is a stabilized system that eliminates the need for the end user to have to balance themselves in the water thereby taking away from the workout experience.

SUMMARY OF INVENTION

Among objectives and advantages of the present invention are:

a.) to provide a human propelled partially/totally submerged cycle that does not have to be assembled before use;

b.) to provide a human propelled partially/totally submerged cycle that, when placed in the water, requires the end user to maintain balance or equilibrium while in use;

c.) to provide a human propelled partially/totally submerged cycle that utilizes a unique front and rear floatation support to allow for different users' body types as well as promote the need to have to balance while in use;

d.) to provide a human propelled partially/totally submerged cycle that utilizes floatation elements that do not require to be inflated;

e.) to provide a human propelled partially/totally submerged cycle that provides a means of propulsion that simulates the motion produced by an octopus;

f.) to provide a human propelled partially/totally submerged cycle that does not require a propeller to create propulsion;

g.) to provide a human propelled partially/totally submerged cycle as a means for exercise by combining the pluses of a bicycle as in balance and resistance pedaling;

h.) to provide a human propelled partially/totally submerged cycle as a means for therapeutic rehabilitation by combining the pluses of a bicycle as in keeping equilibrium which requires I) coordination, ii) upper body strengthening, and iii) resistance pedaling for leg building while reducing the impact of overland cycling by placing the unit in water, a low impact environment;

i.) to provide a human propelled partially/totally submerged cycle as means for a new water sport that requires balance and adjustable pedal resistance to create motion and competition;

j.) to provide a human propelled partially/totally submerged cycle as a fun means of recreation allowing the ability to ride a bike like device even during the winter months, using an indoor pool; and, k.) to provide a human propelled partially/totally submerged cycle that allows the unit and the end user's body to be partially or totally submerged while allowing one's head to be above the water allowing the end user the benefits of semi-flotation as a low impact resistance medium.

Further objects and advantages are to provide a human propelled partially/totally submerged cycle that can be used easily and conveniently to create a safe environment for exercise, health improvement and fun. The goal is to make the device simple to use and at a reasonable cost to manufacture.

Still further objectives and advantages will become apparent from the consideration of the ensuing description and drawings.

The present invention comprises a human propelled partially/totally submerged vehicle which includes a basic frame structure, a front flotation support, a rear flotation support and a pedal assembly. The flotation of the device will be such that when placed in an aquatic environment, the device will be submerged or partially submerged so that at least the head of the end user is maintained above the water. This is to provide a challenge to the end user to have to maintain the devices position in the water without losing balance.

The basic frame structure provides a means for support of the components that make up the device. The basic frame structure has a fixed means that may be permanent, adjustable, self adjusting, or real time adjustable. The basic frame structure herein can be represented by an assembly of plastic tubing such as PVC or other plastic materials, an assembly of aluminum, titanium, composite or other materials. It can consist of an assemblage of square or cylindrical or rectangular shapes designed for support of the flotation supports and pedal system as well as allow the device to be utilized by the end user.

The front flotation support has a fixed means that may be permanent, adjustable, self adjusting, or real time adjustable. When in use the front flotation support may be fully or partially submerged to provide flotation. The front flotation support herein can be represented by an assembly of plastic tubing such as PVC or other plastic materials, an assembly of aluminum, titanium, composite or other materials appropriate in providing flotation such as foam. It can consist of an assemblage of square or cylindrical or rectangular shapes designed to provide a limited amount of flotation such that when an end user is utilizing the device their head is maintained above the water line, while the majority of the device remains below.

Optionally, the front flotation support may have a secondary purpose of providing automatic adjustment of the amount of flotation, depending on the shifting weight of the end user to assist in maintaining balance and desired height out of the water. As an alternative to being self adjusting, the adjustment for the floatation level can be designed to be controlled by the end user. The self adjusting design may be accomplished by a shape that may protrude above the water line. This piece of flotation material may be made out of metal, aluminum, plastic or other means that provides flotation with the added ability to change the amount of flotation by an automatic adjustment of how far the flotation support extends out of the water when in use. The ability for the end user to be able to adjust this can also be designed so that as the end user extends/collapses a section of the flotation device adjusting the amount of the device which extends out of the water, adjusting the position of the user relative to the water line.

An additional optional feature of the front flotation support would be to permit forward and backward sliding movement of the float to assist the end user to maintain balance. The movement may be a pre-set adjustment, self adjusting or a real time adjustment by the end user.

As an additional alternative, the front flotation support may provide steering to assist the end user to maintain a left, right or straight heading. The rotational movement of the front floatation device may be a pre-set adjustment, self adjusting or a real time adjustment by the end user.

The rear flotation support has a fixation means that may be permanent, adjustable, self adjusting, or real time adjustable. When in use, the rear flotation support may be fully or partially submerged tin providing flotation. The rear flotation support herein can be represented by an assembly of plastic tubing such as PVC or other plastic materials, an assembly of aluminum, titanium, composite or other materials. It can consist of an assemblage of square or cylindrical or rectangular shapes designed to provide a limited amount of flotation such that when an end user is utilizing the device their head is maintained above the water line.

The rear flotation support may or may not have a secondary purpose to provide automatic adjustment of flotation amount depending on the shifting weight of the end user to assist in maintaining balance and desired height out of the water. The ability to change the amount of flotation may be designed to be self adjusting or designed to be controllable by the end user. The self adjusting design may be accomplished by a curved shaped. This piece of flotation material may be made out of metal, aluminum, plastic or other means that provides flotation with the added ability to be on a hinged support that allows for automatic adjustment of how far the flotation support extends out of the water when in use. The ability for the end user to be able to adjust this can also be designed so that as the end user extends/collapses a section of the flotation device to raise/lower the device out/into of the water, raising or lowering the end user further away from or closer to the water line.

The pedal system provides a means for the foot of each leg to be placed in a right or left placement with a rotational movement created by pedaling similar to a typical bicycle in a rotational manner creating exercise and or movement that may or may not result in forward motion. The pedal system has a fixed mounting means that may be permanent, adjustable, self adjusting, or real time adjustable. The pedal system herein can be represented by an assembly of plastic tubing such as PVC or other plastic materials, an assembly of aluminum, titanium, composite or other materials. It can consist of an assemblage of square, cylindrical, rectangular, or other polygonal shapes with the ability to provide a rotational movement and a placement for the feet. An optional bearing may be incorporated for smoother movement.

Optionally, the pedal system may have a secondary purpose of intentionally providing forward or backward movement when an end user begins to pedal. This movement can be accomplished by use of an open and close cupping action on the pedal system modeled after the motion of an octopus' movement. The cupping action is provided by a curved, rectangular, or cylindrical shaped piece of material that when moved through the liquid environment acts like a scoop that catches the water when the foot is moving rearward creating forward propulsion. When the foot is moving forward, the scoop naturally closes and acts like a round smooth shape that allows water to easily pass around it without impeding the forward movement.

By combining the elements of flotation, that places the end user's head above the water line, while maintaining the device in a fully/partially submerged state, when pedaling the device in a viscous environment, the end user will find it necessary to work to maintain balance/equilibrium. The ease with which this equilibrium is maintained can be adjusted by i) repositioning the flotation supports, ii) steering the device, and, iii) adjusting one or both flotation devices, either by physical movement of a portion of the flotation device or by adding or removing water to/from the flotation support to adjust for the end user's specific need/taste. With the added benefit of motion created by an Octopus-like movement designed into the pedaling system, an end user will experience a workout that is low impact while providing the ability to adjust the level of resistance, and strength required for balancing, making the Aquatic Equilibrium Cycle unique in the industry as an exercise/rehabilitation tool, a recreational cycle, or as a competitive sport device.

DRAWINGS

A the preferred embodiments of the present invention are depicted in the figures, in which FIG. 1A is a schematic side view of a first embodiment of the aquatic equilibrium cycle of the present invention;

FIG. 1B is a perspective front view of the first embodiment;

FIGS. 2C and 2D are schematic depictions showing proper positioning of the center of gravity using the real time user adjustable front flotation support;

Figure 5A:
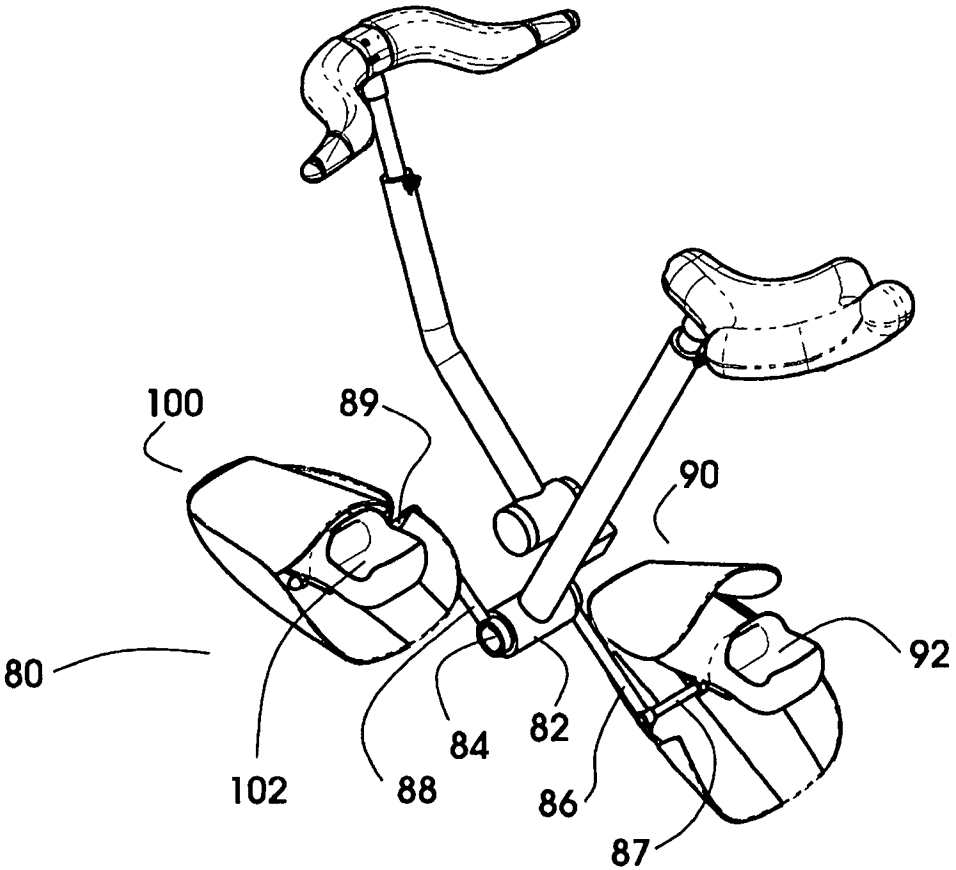
Figure 5B:
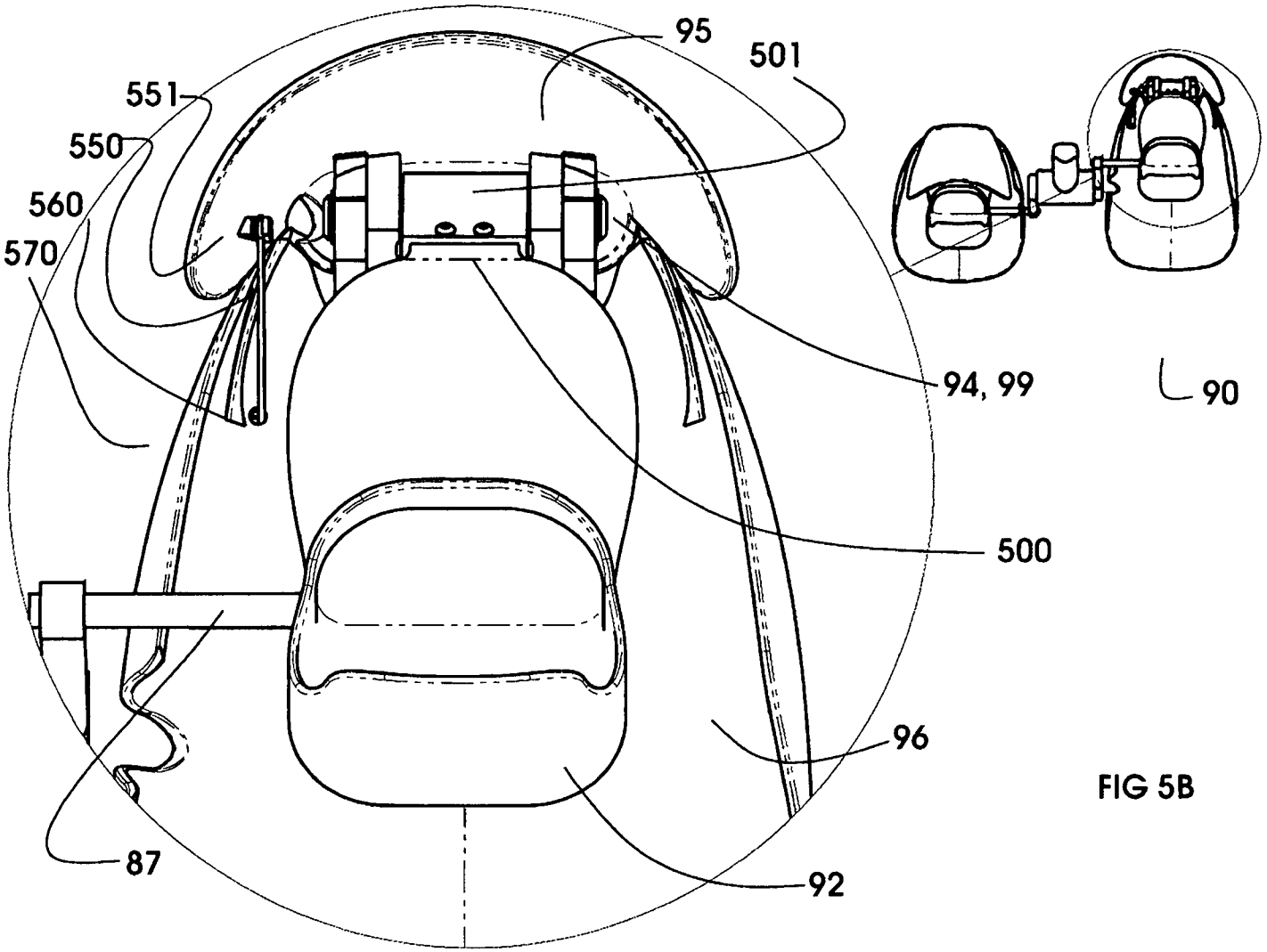
Figure 5C:
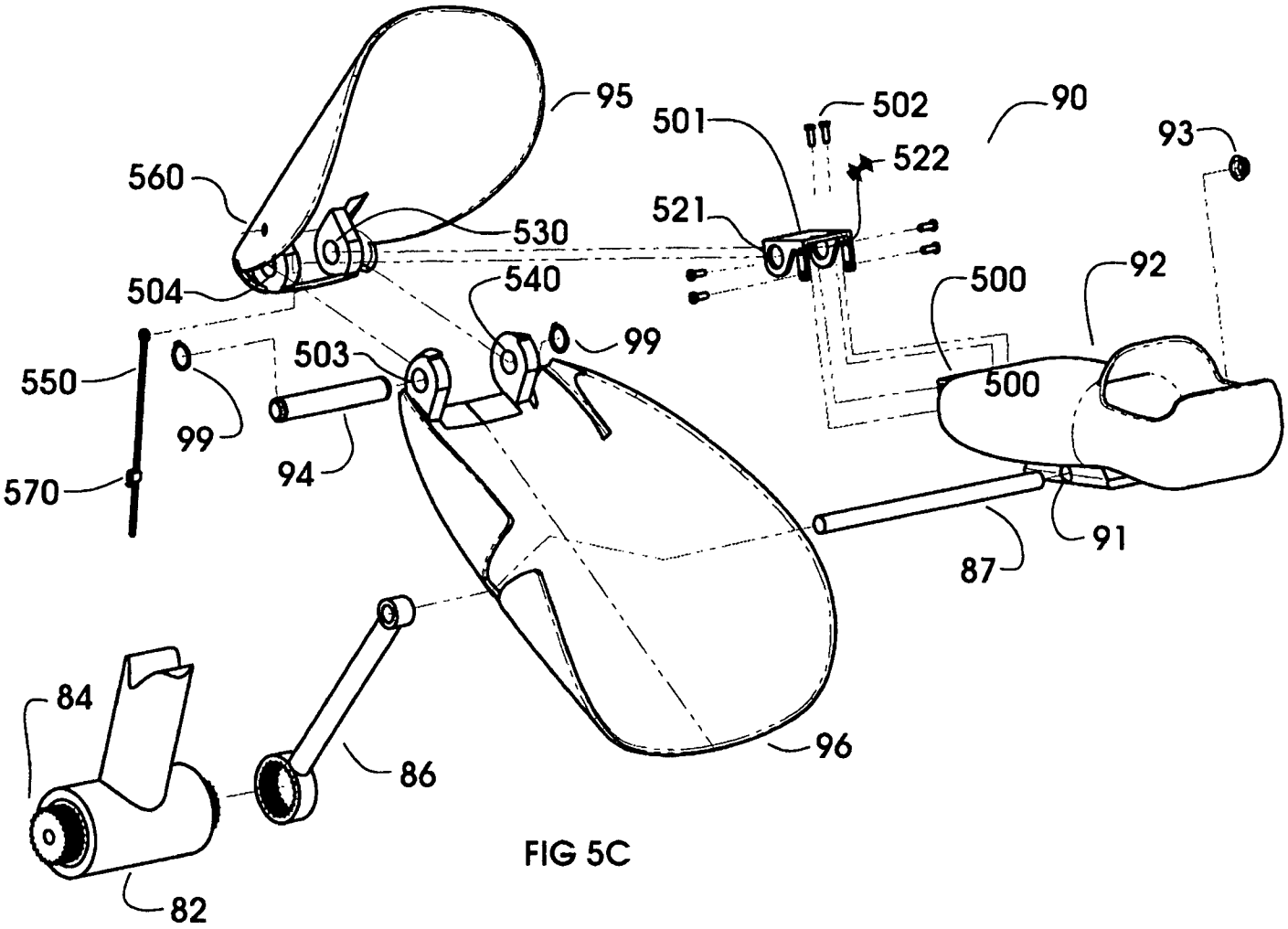
Figure 6A:
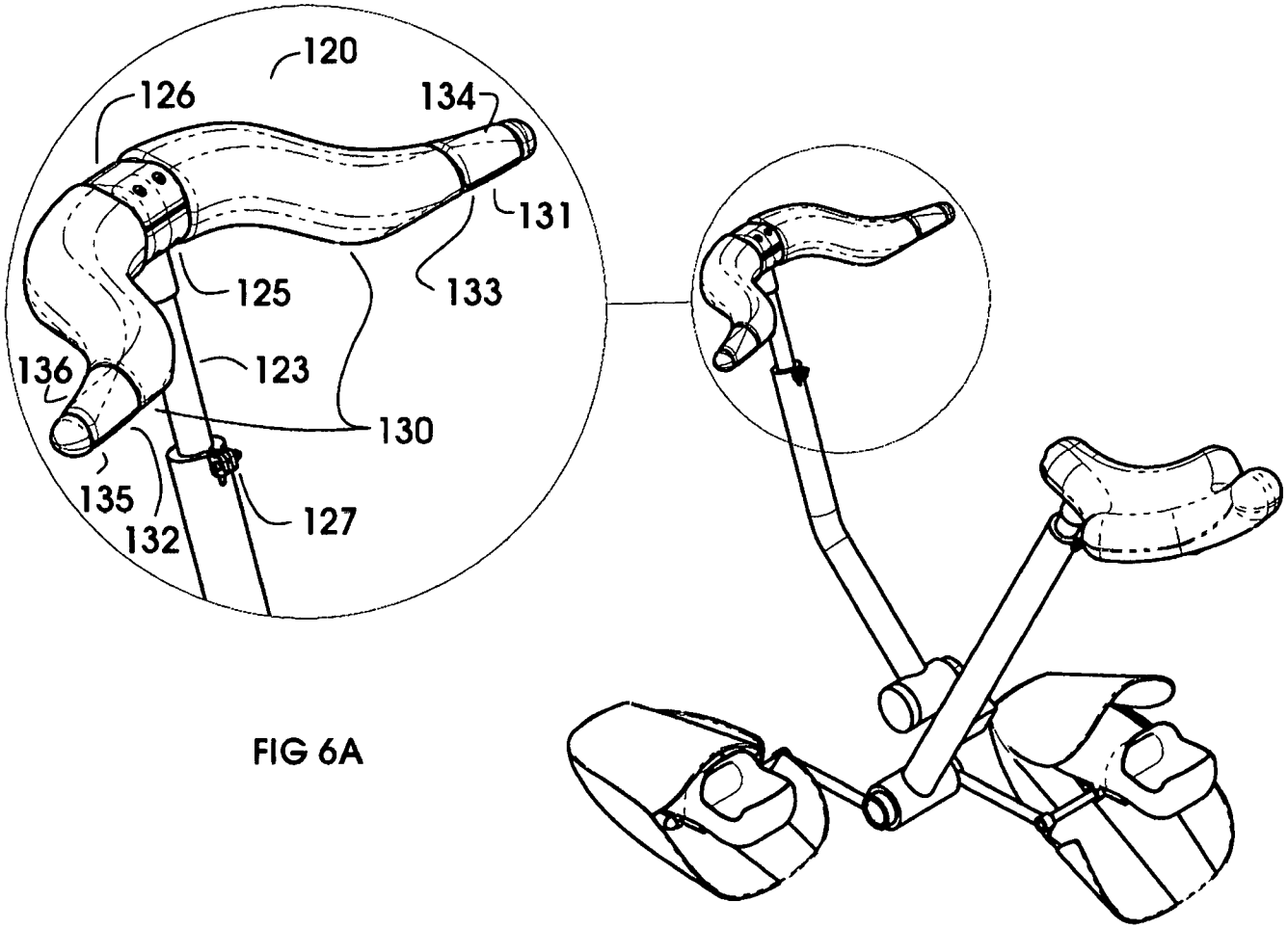
Figure 6B:
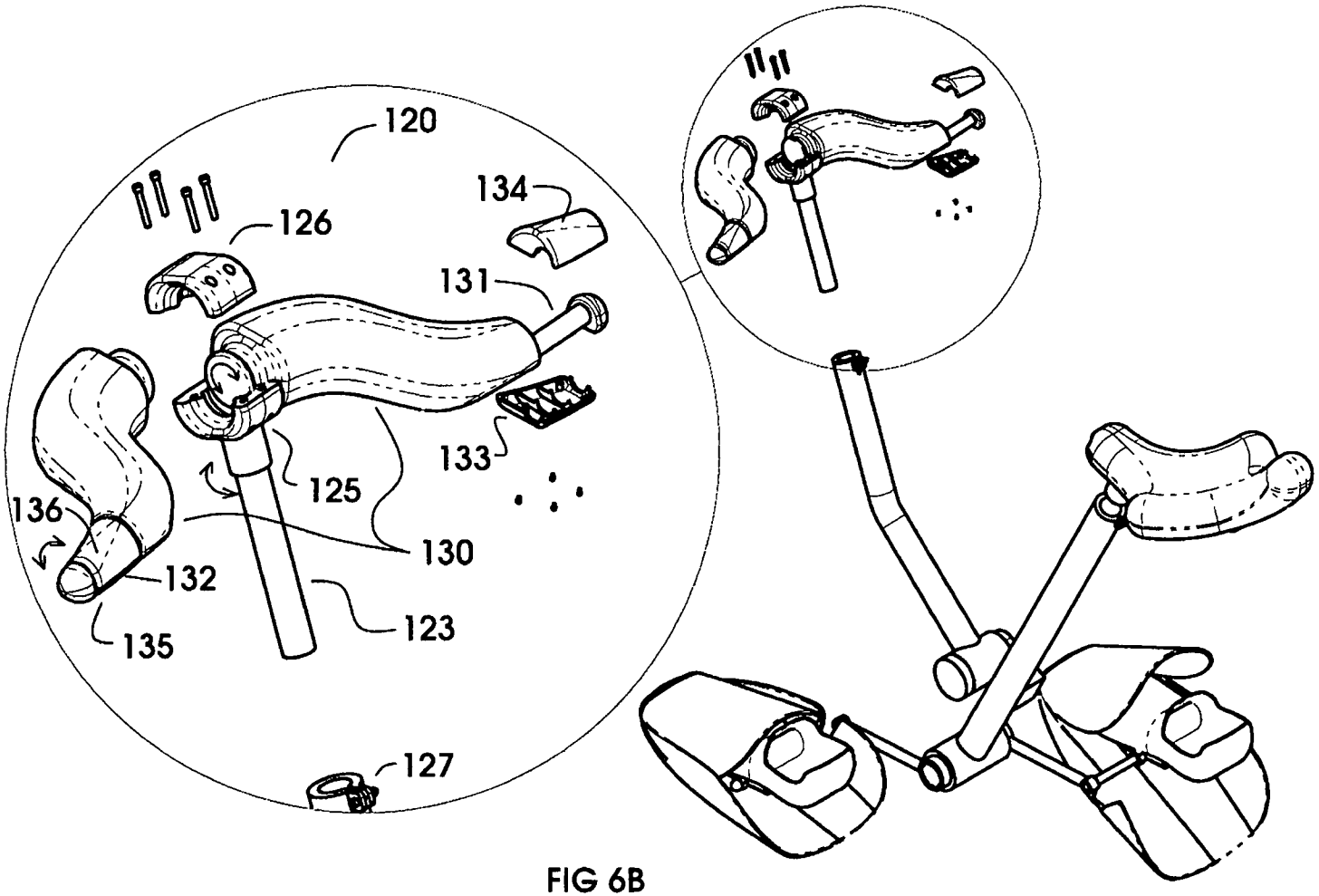
Figure 7B:
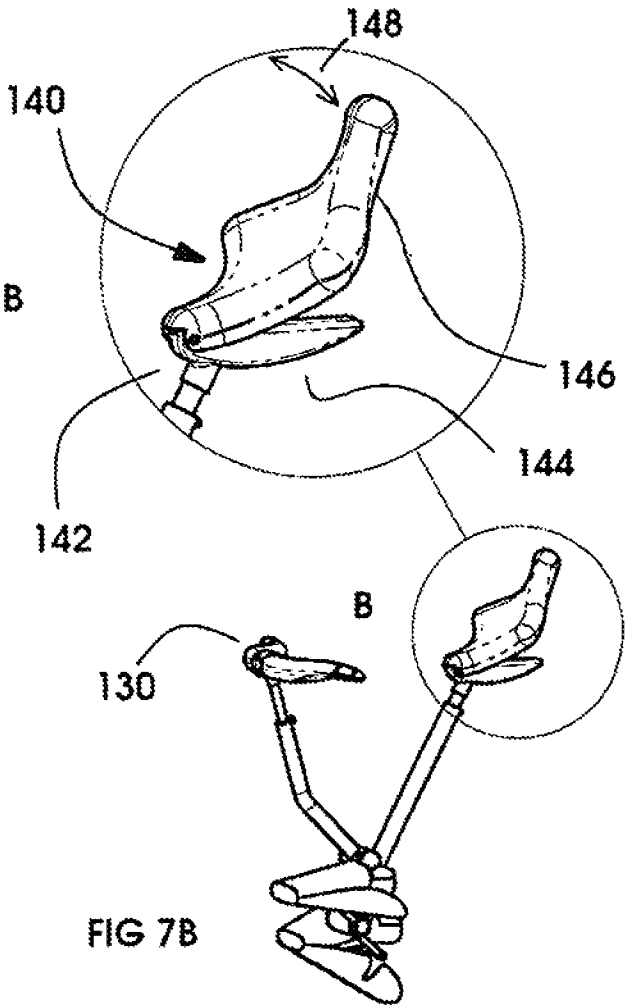
Figure 7A:
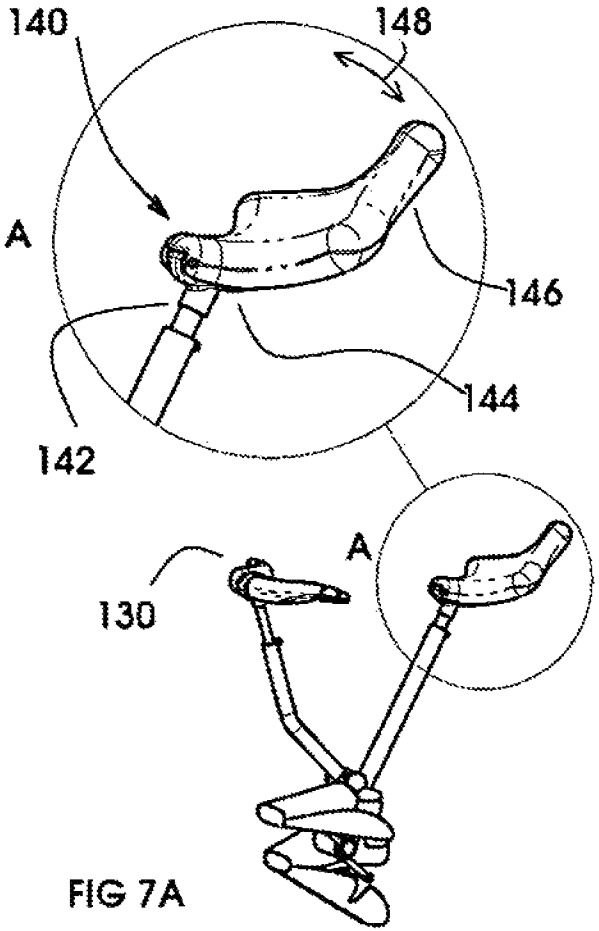
Figure 8:
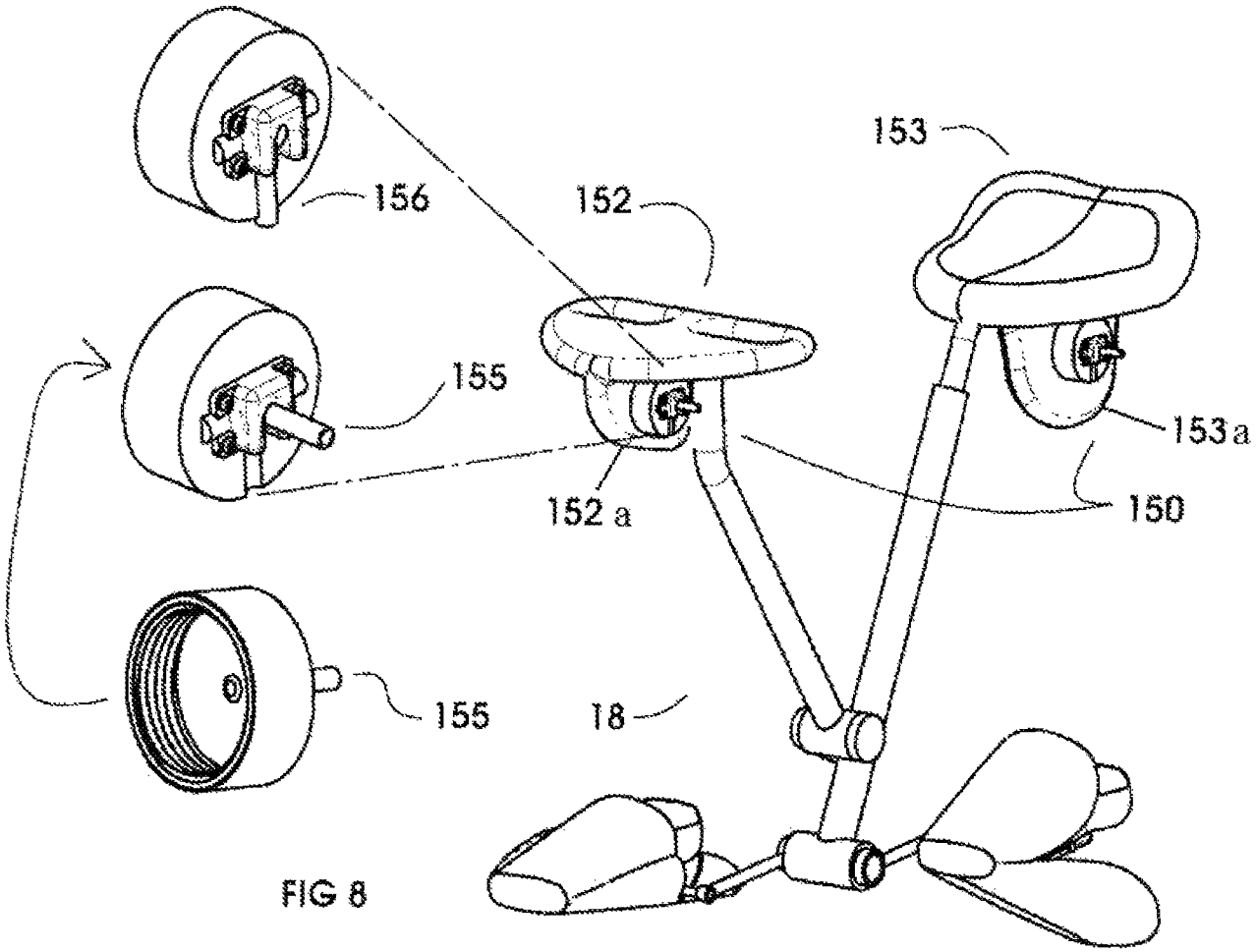

FIGS. 4A-4G schematically depict the third embodiment featuring the"V" frame highlighting its dual purpose of real time adjustment and foldable storage for compact transport;

FIG. 5A is a rear perspective view of the third embodiment featuring the octopus pedal system;

FIG. 5B is a detailed rear perspective view of the pedal assembly of the third embodiment;

FIG. 5C is an exploded perspective view of the pedal assembly of the third embodiment;

FIGS. 5D-5I, depict successively 6 pedal positions and the changes to the wing positions that create the octopus closing and opening action;

FIG. 6A is a rear perspective view of the real time user adjustable handlebar flotation support of the third embodiment;

FIG. 6B is an exploded rear perspective view of the handlebar floatation support of the third embodiment;

FIG. 7A is a perspective side view the self adjusting split seat flotation support in a first extreme position;

FIG. 7B is a perspective side view of the self adjusting split seat flotation support in the second opposite extreme position; and, FIG. 8 is a front perspective view of a fourth embodiment highlighting the user specific buoyancy adjustment embodiment in which the flotation supports can be preset by how much water is let inside each of them.

DETAILED DESCRIPTION OF PREFERRED EMBODIMENTS

A first embodiment of the aquatic equilibrium cycle of the present invention is shown in FIGS. 1A and 1B generally at 10. The cycle 10 shown here in its simplest form comprises a basic frame structure 20 securing the front flotation support 30, the rear flotation support 50, and the pedal assembly 70.

The basic frame structure 20 consists of a main horizontal shaft 22, coupled by a "T" 25 connecting to a main vertical shaft 26. Front end cap 23 on the main horizontal shaft 22 is used to attach the front flotation support 30 and the rear end cap 24 on the main horizontal shaft 22 secures the rear flotation support 50. At the bottom of the main vertical shaft 26 is the pedal assembly 70. The basic frame structure 20 is rigid and can be cylindrical, rectangular or of any shape to facilitate a light weight frame construction. It can be made of plastic; metals such as titanium and aluminum; composite or any light strong material that can be assembled together. The material may be treated to be impervious from breakdown due to water, salt water, or other viscous environments in which the Basic Aquatic Equilibrium Cycle 10 may be used.

The front flotation support 30 may be affixed to the front of the horizontal shaft 22 or, more preferably, be axially adjustable so that the flotation can be set to a position that is suitable for the particular end user 310 to keep their head above the water line 320, while creating a fully/partially submerged front flotation support 30 in the aquatic environment. The front flotation support 30 can be cylindrical, rectangular or of a shape to facilitate a light weight frame construction. It can be made of plastic; metal such as titanium or aluminum; composite or any light strong material that can be assembled together to create flotation. The material may be treated to be impervious from breakdown due to water, salt water, or other viscous environments in which the Basic Aquatic Equilibrium Cycle 10 may be used.

The rear flotation support 50 may be affixed to the rear of the horizontal shaft 22 or, more preferably, be axially adjustable so that the flotation can be set to a position that is suitable for the particular end user 310 to maintain their head above the water line 320, while creating a fully/partially submerged rear flotation support in the aquatic environment. The rear flotation support 50 can be cylindrical, rectangular or of a shape to facilitate a light weight frame construction. It can be made of plastic; metal such as titanium or aluminum; composite or any light strong material that can be assembled together to create flotation. The material may be treated to be impervious from breakdown due to water, salt water, or other viscous environments in which the Basic Aquatic Equilibrium Cycle 10 may be used.

The pedal assembly 70 in its simplest form is similar in design to a typical human powered bicycle in that it has a center pedal shaft housing 72 to support a bearing surface for the center pedal shaft 74. The center pedal shaft 74 has a right pedal extension 76 that is attached perpendicular to it. The center pedal shaft 74 has a left pedal extension 78 attached perpendicular to it 180 degrees opposite of the right pedal extension 76. Attached to the end of the right pedal extension 76 in a perpendicular manner similar to a typical human powered bicycle is the right pedal 77. Attached to the end of the left pedal extension 78 in a perpendicular manner similar to a typical human powered bicycle is the left pedal 79. The pedals 77, 79 are designed such that the pedals are free to rotate while being pedaled to ensure the pedals maintain contact with the human foot.

FIG. 1A shows the Basic Aquatic Equilibrium Cycle 10 partially submerged in a body of water where the end user 310 is kept afloat such that their head is protruding above the water line 320. The front flotation support 30 and the rear flotation support 50 are kept fully/partially submerged. Flotation supports 30, 50 produce an upward force attempting to break through the water line 320 surface. As the user pedals equilibrium cycle 10, this upward force creates an interaction with the end user that requires the need to maintain balance, fore-and-aft as well as side-to-side, while operating pedal assembly 70. This basic embodiment is very challenging since the end user has to shift their weight forward or backward or side to side, to maintain balance while using the Basic Aquatic Equilibrium Cycle 10. In this basic embodiment the front flotation support 30 and the rear flotation support 50 may need to be sized specifically to match the end user's 310 need to maintain balance while keeping the floats 30, 50 fully/partially submerged below the water line 320. The additional embodiments below provide options that allow for shifting the front flotation support 30 from front to back to allow the end user a more enjoyable experience while creating arm movement for exercise as well as providing a self adjusting rear flotation support 50.

Figure 2A:
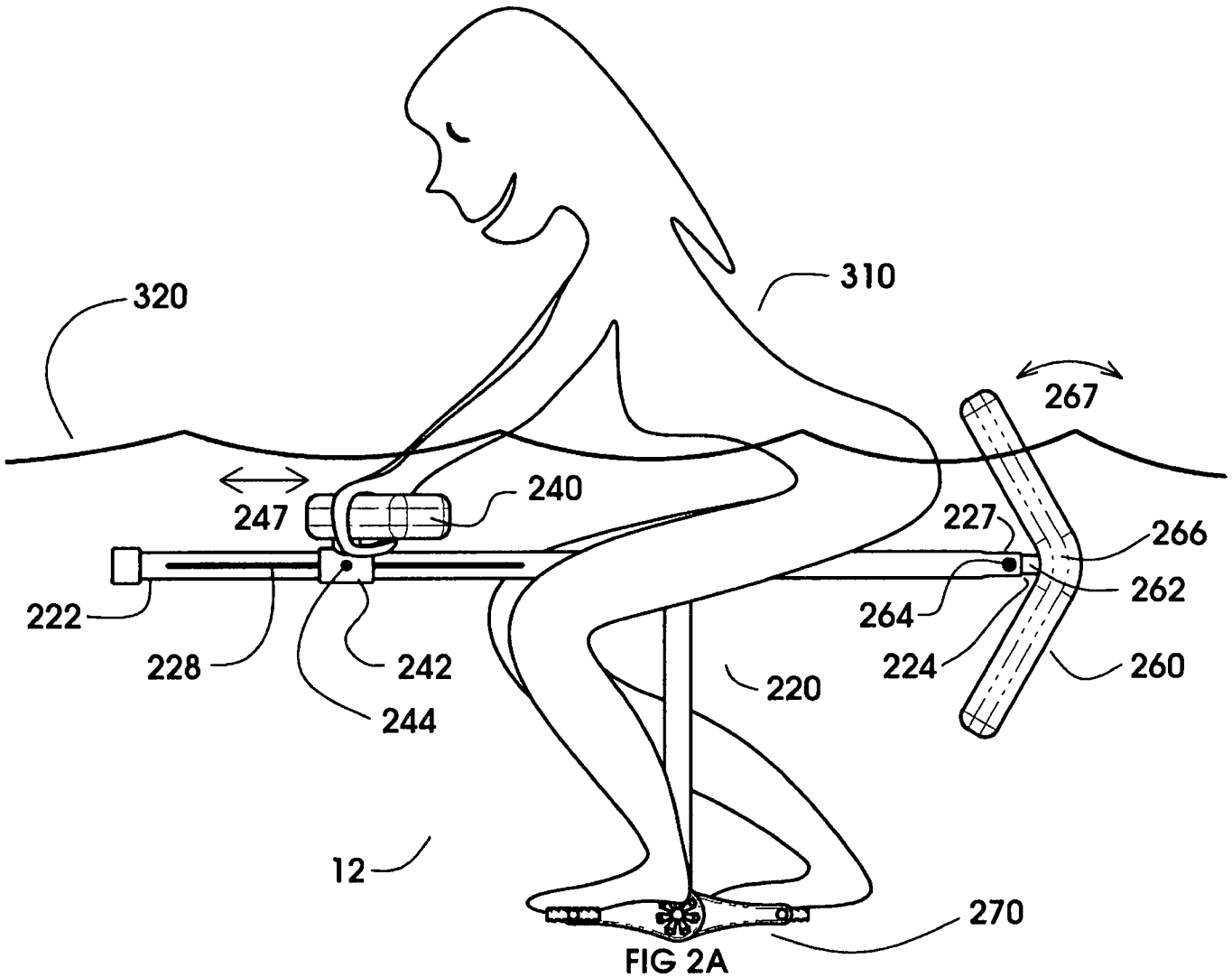
FIG. 2A is a schematic side view of a second embodiment highlighting the real time user adjustable front flotation support and self adjusting rear flotation support.
Figure 2B:
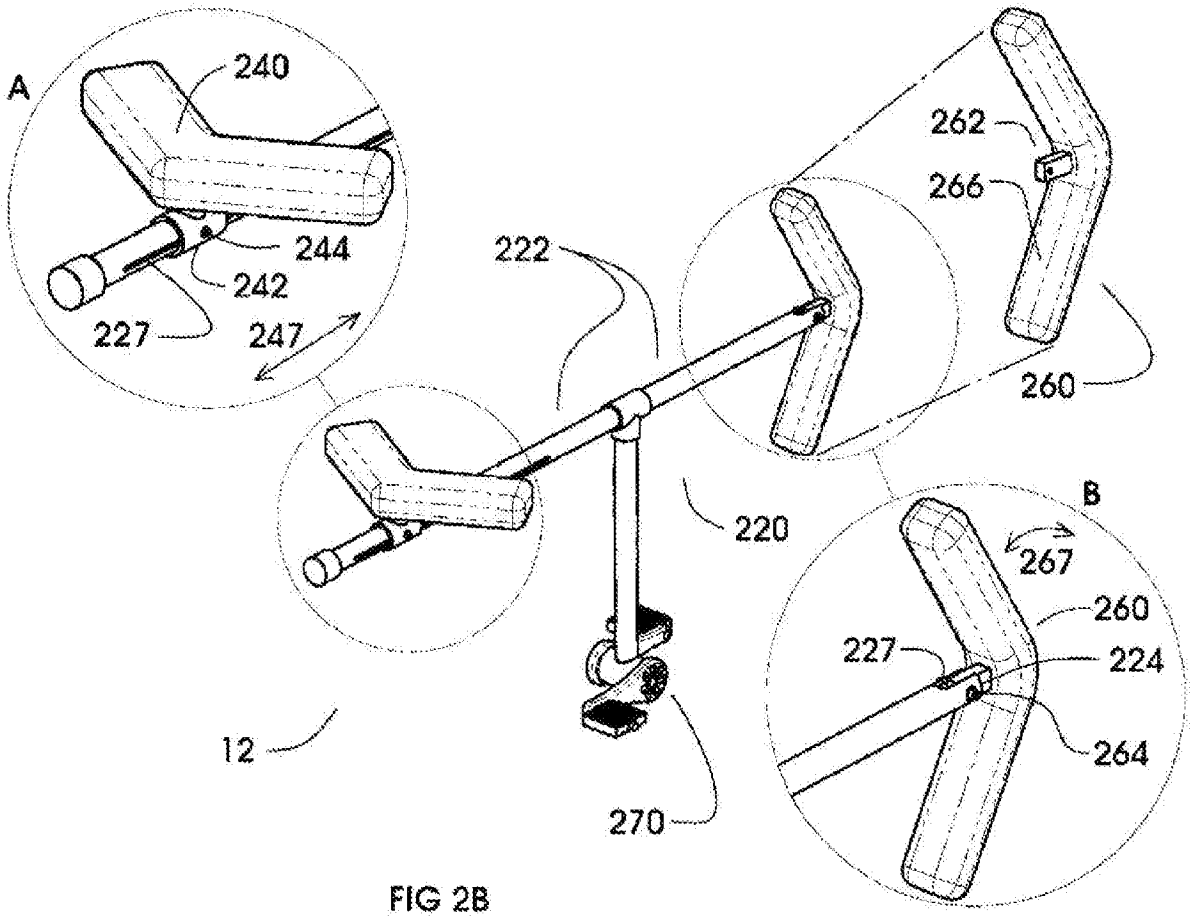
FIG. 2B is a perspective side view of the second embodiment with detailed views of the front and rear floatation supports.

Referring to FIG. 2A and FIG. 2B, a second embodiment of the Aquatic Equilibrium Cycle is shown generally at 12. Second embodiment 12 includes basic frame structure 220 securing the real-time, user-adjustable front flotation support 240 by means of a pair of slots 228 (one shown) extending along each side of the main horizontal shaft 222. Fastener 244 extends through the sleeve 242 that slides along shaft 222 and through the slot 228 thereby allowing free movement to slide the real time user adjustable front flotation support 240 in a forward-and-backward motion 247. This forward-and-backward motion 247 allows weight and floatation force redistribution affecting the center of gravity balance point to move, thereby allowing the end user to adjust balance in real time by arm movements. The other additional feature of this embodiment and all embodiments to follow is the ability for the real-time, user-adjustable front flotation support 240 to also move in a rotational manner to allow for steering of the Aquatic Equilibrium Cycle while in forward motion.

To assist in maintaining an equilibrium point of balance, the self adjusting rear flotation support 260 is secured to the main horizontal shaft 222 by a slot 227 created in the aft shaft 224. A fastener 264 is utilized through the aft shaft 224 that loosely fastens the tab 262 protruding from the semi-arc flotation housing 266, thereby allowing the self adjusting rear flotation support 260 to move freely in an arcuate rotational motion 267. This arcuate rotational motion 267 allows for automatic self-adjustment of the flotation redistribution affecting the center of gravity balance point to move a very small amount, thereby allowing automatic adjustment of the rear balance in reference to the front balance point.

Referring to FIG. 2A and FIG. 2B, in use, the end user 310 grabs hold of the real-time user-adjustable front flotation support 240 at its outermost ends, similar to grabbing the handlebars at the handle grips on a conventional bicycle. As the end user 310 engages the pedal system 270, the real-time, user-adjustable front flotation support 240 can be moved forward and backward and rotated clockwise or counterclockwise to allow for the need to maintain balance while being partially submerged below the water line 320 as well as allow the end user to steer while in the water.

Referring to FIGS. 2C and 2D, the equilibrium is maintained by the end user's 310 movement of the real-time, use-adjustable front flotation 240 away from the end user 310 or closer to the end user 310 causing the balancing point 701 between the front flotation 240 and the back flotation 260 to shift such that the flotation devices are creating an upward force countering the end user's weight which is pushing downward. This upward force requires the end user to maintain the center of weight distribution 269 between the flotation devices at the balancing point 701 or the front end or back end of the Equilibrium Cycle will sink further into the water causing the end user to lose balance. In FIG. 2D, the end user 310 is maintaining the balancing point 701 at the center of gravity 700 and at the center of weight distribution 269.

If the end user 310 moves the real-time, use-adjustable front flotation support 240 too far inward toward the end user 310, the center-of-gravity is moved rearwardly causing the rear of the unit to sink downward. The end user 310 will correct this condition by moving the center of weight distribution 269 more toward the front past the balancing point 701 and off center of the upward push from the center of gravity 700.

Should the end user 310 move the real time user adjustable front flotation support 240 too far forward away from the end user 310, the center-of-gravity will be shifted forward causing the front end of the unit to fall. The end user 310 can correct this situation by moving the center of weight distribution 269 toward the back of the unit to align with the center of gravity 700 and the balancing point 701.

Referring back to FIG. 2A and FIG. 2B, to assist in this somewhat delicate balance the self adjusting rear flotation support 260 will move as needed in an arc motion 267 to slightly move the center of gravity point 269 closer to where it should be to maintain balance.

By providing a means for the end user 310 to maintain balance as needed, second embodiment 12 of Aquatic Equilibrium Cycle becomes a simple, but effective, form of exercise that is the closest to emulating the need to maintain balance as is often the case with a land based bicycle, making the Aquatic Equilibrium Cycle riding experience unique and dynamic.

Figures 3A, 3B:
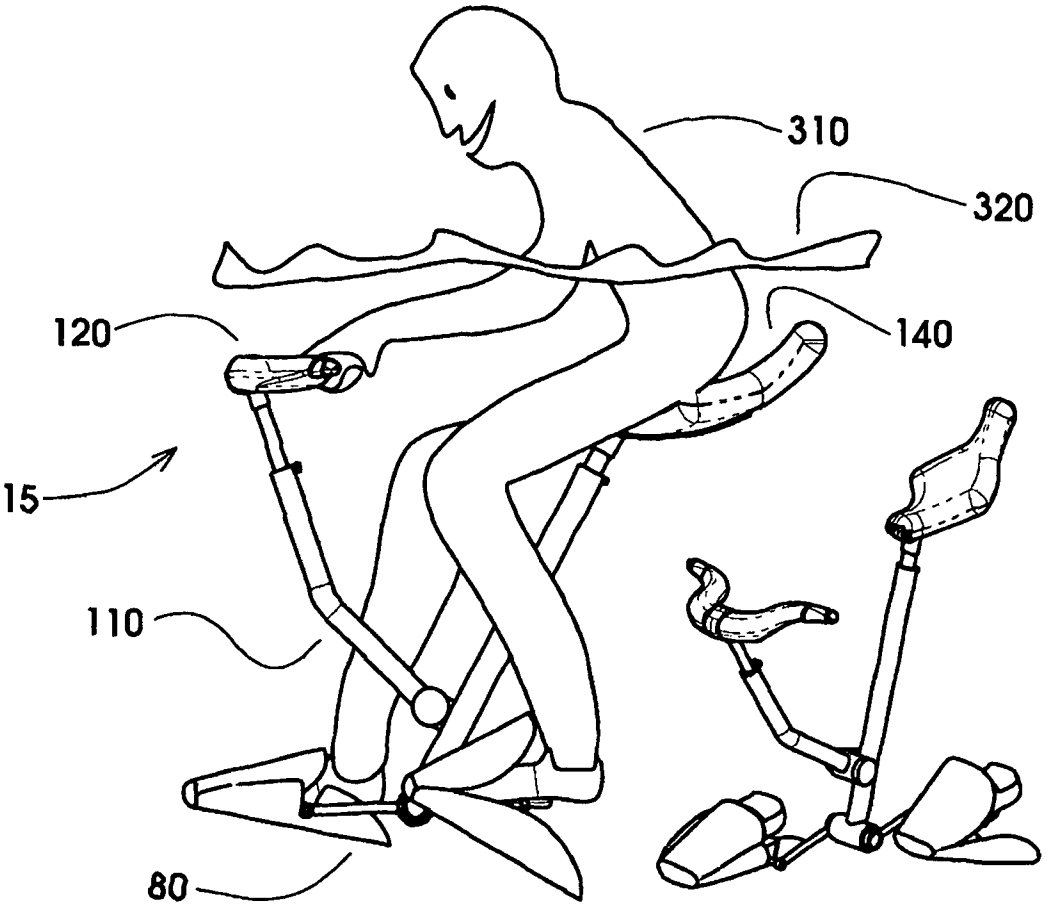
FIG. 3A is a schematic side view of a third embodiment highlighting the "V" frame structure, octopus pedal assembly, real time user adjustable handlebar flotation support and the self adjusting split seat flotation support.
FIG. 3B is a front perspective view of the third embodiment.

Referring to FIG. 3, a third embodiment of Aquatic Equilibrium Cycle is depicted generally at 15. Third embodiment 15 consists of a "V" frame structure 110 securing the octopus pedal system 80, the real-time, adjustable handlebar flotation support 120 and the self-adjusting split-seat flotation support 140.

Figure 4G:
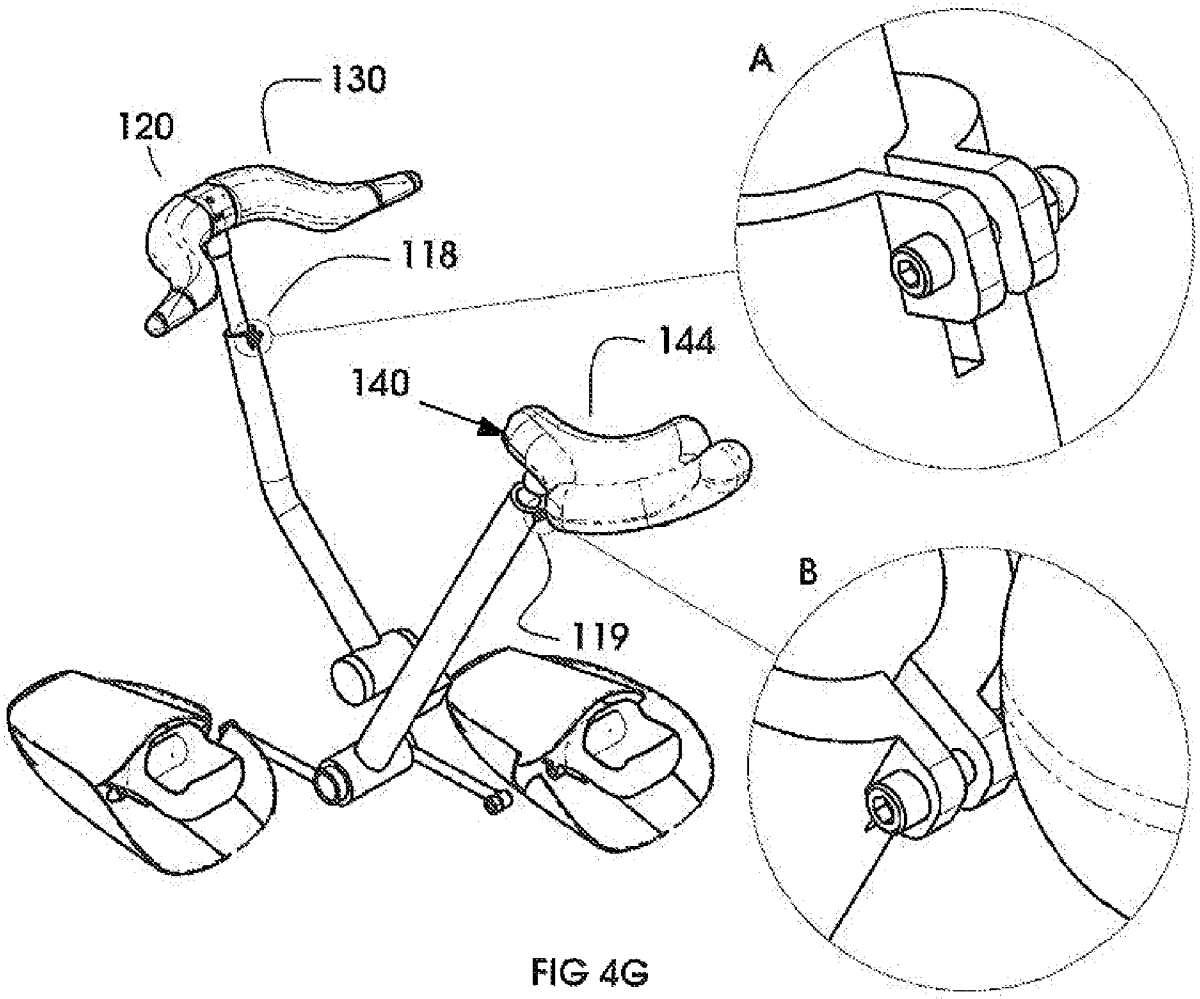

Referring to FIG. 4A, the "V" frame structure 110, in the usable, open state, is very similar to a land based bicycle in appearance but unique in utility and functionality. Referring to FIGS. 4B, 4C and 4D, the "V" frame structure 110 is designed with a hinge point 112 that has a dual purpose to allow real-time adjustable movement 114 as shown in FIG. 4B to be fully extended, at the mid-point in FIG. 4C and pulled inward in FIG. 4D highlighting the possible positions one could place the real time user adjustable handlebar flotation support 120 while in use. FIGS. 4E and 4F demonstrate the provision of a means for folding the unit 116 for transport or storage. Referring to FIG. 4G, the "V" frame also incorporates a handle bar attachment hub 118 and the seat attachment hub 119, that incorporate a typical turn and lock or bolt clamp design to allow for adjustment of the seat height or handlebar height similar in design to a conventional land bicycle.

Referring to FIG. 5A, the octopus pedal system 80 in its base form is similar in design to a conventional bicycle in that it has a center pedal shaft housing 82 to support a bearing surface for the center pedal shaft 84. The center pedal shaft 84 has a right pedal extension 86 that is attached perpendicular to it. The center pedal shaft 84 has a left pedal extension 88 attached perpendicular to it 180 degrees opposite of the right pedal extension 86. Attached to the end of the right pedal extension 86 in a perpendicular manner similar to a typical human powered bicycle is the right pedal shaft 87. Attached to the right pedal shaft 87 is the right octopus pedal assembly 90. Attached to the end of the left pedal extension 88 in a perpendicular manner similar to a typical human powered bicycle is the left pedal shaft 89. Attached to the left pedal shaft 89 is the left octopus pedal assembly 100. The right octopus pedal assembly 90 and the left octopus pedal assembly 100 are similar in function except one is designed for the right side and the other is a mirror designed for the left side. The operation and assembly of the right octopus pedal assembly 90 and the left octopus pedal assembly 100 overall are identical and only the right octopus pedal assembly 90 will be reviewed in that the same technology would apply to both the right and left.

Referring to FIGS. 5B and 5C, the right octopus assembly 90 begins at the attachment of the right pedal shaft 87 to the right inner shoe 92. The right inner shoe 92 is designed similar to the shoe part of a typical diving fin to allow for the fit of a large variety of foot sizes. The right inner shoe 92 can be made of rubber, plastic, silicone, composite or of any material that will be consistent with housing a foot in a comfortable manner while in a viscous environment. The right inner shoe 92 has an attachment center hole 91 that goes completely through the base to allow the right inner shoe 92 to slip over the right pedal shaft 87. There can be a variety of methods for this attachment as the outlined method here is one form of potentially many to accomplish the assembly. The right pedal shaft 87 holds the right inner shoe 92 in place by an end termination 93 that allows the right inner shoe 92 to rotate freely on the right pedal shaft 87 without falling off. This end termination 93 can be in the form of an end cap or washer held in place by a cotter pin or other methods that still allows free rotation of the right inner shoe 92. On the far front end of the right inner shoe 92 beyond the toes is the shoe attachment block 500 used for fastening the main hinge plate 501 to it. The plate is designed to hold the central hinge shaft 94 that connects the right upper wing 95 and the right lower wing 96. The location of the central hinge shaft 94 is not limited and can be located anywhere along the inner shoe that would facilitate proper functionality. The central hinge shaft 94 could be molded into the right inner shoe 92, or it could be attached in a variety of common practices for securing a shaft to another member. The right upper wing 95 and the right lower wing 96 attach to the inner shoe 92 by means of the central hinge 94 creating alignment with the right upper wing 95, to the right lower wing 96, to the inner shoe via the shoe attachment block 500 secured to the main hinge plate 501. All units are allowed to move freely but only at the hinge joint provided by the central hinge shaft 94 and are prevented from slipping off by the retaining clips 99 but are allowed to open and close freely on the central hinge shaft 94. To insure optimum performance the design was kept simple in which a shaft is forcing various holes to align in position to three different parts. The right upper wing 95 and the right lower wing 96 could also be designed to snap onto the central hinge shaft 94 as an alternative arrangement.

Referring to FIG. 5C, the manner in which the components are assembled allow for a hinged clamshell design all on one central hinge shaft 94. The central hinge shaft 94 is placed into the lower shaft hole 503 of the right lower wing 96. The right upper wing 95 is aligned so the upper left shaft hole 504 aligns with the lower left shaft hole 503 as the central hinge shaft 94 is pushed partially through. The shoe hinge plate 501 is placed in-between the right upper wing 95 in alignment with the left upper shaft hole 504 so that the central hinge shaft 94 could be pushed through the left shoe plate hole 521 and then through the right shoe plate hole 522. The central hinge shaft 94 would then be pushed through the right upper wing hole 530 and finally through the right lower wing hole 540. Both ends of the central hinge shaft 94 would be held in place by retaining clips 99. The final step of the assembly is the attachment of shoe hinge plate 501 to the shoe attachment block 500 by means of a set of socket head cap screws 502.

The means to create an equal movement of the right upper wing 95 in respect to the right lower wing 96 may become essential in the final version of the invention. There are many methods that can be applied to accomplish this outcome one of which is to have a set of gears that as the upper wing begins to open the gears force the lower wing to open an equal amount. Another method to accomplish the equal movement is by way of a three pin articulated arm that as the upper wing opens the arm moves in a slot and is attached to the lower wing causing both wings to move equally. Although these are not shown in this application, they may become an essential part to the final invention and are noted here as part of the invention.

The need to be able to adjust the opening of the upper wing in relation to the lower wing is essential in controlling the amount of resistance in the device while pedaling. A very simple version of the opening limiter 550 is shown in FIGS. 5B and 5C. It is basically a modified tie wrap, typically used to tie down electrical wires only this design allows the end user to clasp it to a certain location and later release it, to set it for a new opening. The opening limiter 550 would be attached with a spring pin to the underside of the right upper wing 95 at the limiter attachment hole 551. The lower end of the opening limiter 550 would slide through the lower wing limiter hole 560. The adjustable limiter attachment clasp 570 would be added and slid to the desired height to limit the opening of the right upper wing 95 with respect to the right lower wing 96 causing an increase in resistance if the opening is allowed to become large or a decrease in resistance if the end user sets the opening to a restricted or smaller amount.

Figure 5D:
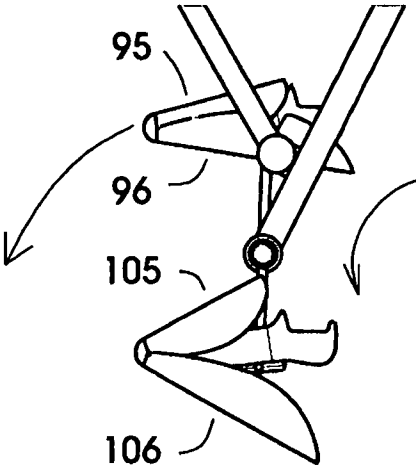

Referring to FIG. 5D, 5E, 5F, 5G, 5H, 5I, the opening and closing of the right upper wing 95 and right lower wing 96 and the left upper wing 105 and left lower wing 106 is controlled by the movement of the end user 310 when pedaling in a forward circular motion, the explanation of which is provided in further detail under the operation in this section. The general principle as shown in FIG. 5D is as octopus pedal 90 moves forward, the right upper wing 95 and the right lower wing 96 close and as the continued pedaling causes the respective octopus assembly 100 to move rearward on the Aquatic Equilibrium Cycle, the left upper wing 105 and the left lower wing 106 begin to open, catching more water and creating forward thrust. As the pedals move around in a forward revolution, the wings on the right close as the wings on the left open and vice versa.

Referring to FIG. 6A, the real-time, user-adjustable handlebar flotation support 120 is designed to be both a flotation support with the added benefit of real-time adjustability by whoever is using the device and a steering mechanism. The real-time user-adjustable handlebar flotation support 120 consists of the support shaft 123 which has a built in bearing that allows the lower main hinge hub 125, to rotate clockwise or counterclockwise similar to steering on a land bicycle. The lower main hinge hub 125 creates a clamp-like design with the upper main hinge hub 126. This hinge clamp 127 holds the entire handlebar 130 in place while allowing it the freedom to rotate in a circular arc to allow for adjustment in use. The handlebar 130 is hollow and sealed, creating flotation.

Referring to FIG. 6B, attached to the right handle grip shaft 131 on the handlebar 130 is the lower right handle grip 133 and upper right handle grip 134. They are attached by 4 screws clamping over the right handle grip shaft 131 in such a way as to allow free rotation on the right handle grip shaft 131. On the left handle grip shaft 132 is the lower left handle grip 135 and the upper left handle grip 136 sandwiched together to hold onto the left handle grip shaft 132. They are attached by screws in such a way as to allow free rotation on the left handle grip shaft 132.

The clockwise and counterclockwise steering motion of the lower main hinge hub 125 on the support shaft 123 can be locked in place if desired as can the assembly at the hinge point 112, at the handlebar 130 to the main hinge hub 126 and lower hinge hub 125. Although these features are not shown in the drawings there may be a need especially in a therapeutic rehabilitation to create a safer environment by eliminating variables for the end user in the form of locking those specific features out.

Referring to FIGS. 7A and 7B, the self adjusting split seat flotation support 140 consists of the main shaft 142 attached to the bottom of the seat 144, which has a connection to the split flotation support 146 that allows the split flotation support 146 to move in an arc 148. The split flotation support 146 is hollow and sealed to create flotation.

Referring to FIG. 3, the third embodiment 15 of the Aquatic Equilibrium Cycle would be placed in an open body of water. Then, the "V" frame structure (FIG. 4A) would be opened or unfolded at the hinge point 112. At this point, the end user 310 would sit on the self adjusting split seat flotation support 140 and adjust the seat 144 at the seat attachment hub 119 to adjust the unit to the correct height (FIG. 3 and FIG. 4G). This may require the assistance of another person, initially. The end user would adjust the height of the real-time, user-adjustable handlebar flotation support 120 at the attachment hub 118. Again, assistance to hold the end user 310 in position while this adjustment is made may be required to get the setting correct. After the cycle is adjusted in height, the end user 310 can then begin to put the cycle into use.

Referring to FIGS. 5A, 6A, the end user would grab hold of the right handle grip assembly 133, 134 and the left handle grip assembly 135, 136 and then place their feet into the left inner shoe 102 and right inner shoe 92. At this point, in order to maintain their balance, the user will need to hold onto the handle grip assembles 133, 134, 135, 136 while moving up or down or right or left to move the handlebar 130 of the real-time, user-adjustable handlebar flotation support 120 forward and backward and a little up or down or left or right.

Referring to FIGS. 7A and 7B, the self adjusting split seat flotation support 140 self adjusts along the arc 148 by movement of the split flotation support 146 counteracting the movements of the handlebar 130 to assist in maintaining balance. Once the end user 310 becomes comfortable with maintaining their balance, they can begin to pedal as if they are pedaling a normal bicycle. When the user starts to pedal, the octopus pedal system 80 begins to automatically open and close due to the resistance of the water providing forward propulsion.

Figure 5E:
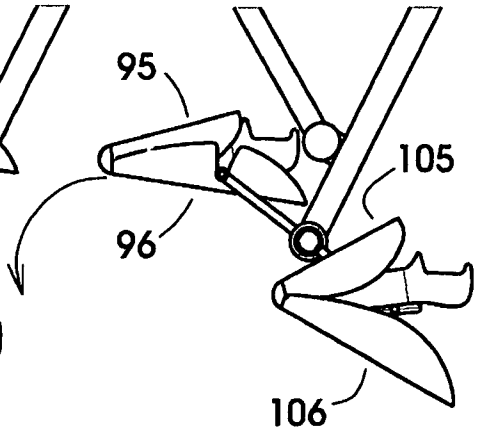
Figure 5F:
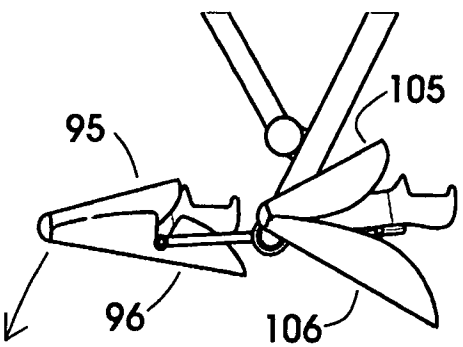
Figure 5G:
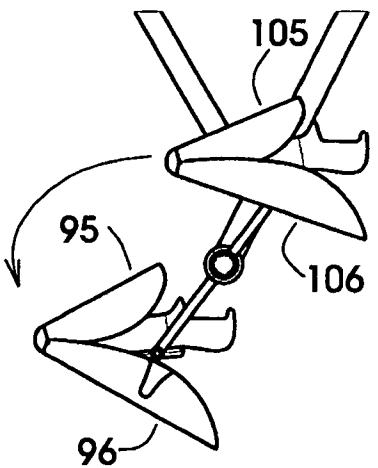
Figure 5H:
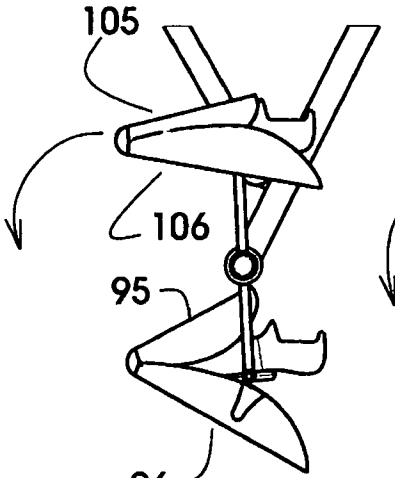
Figure 5I:
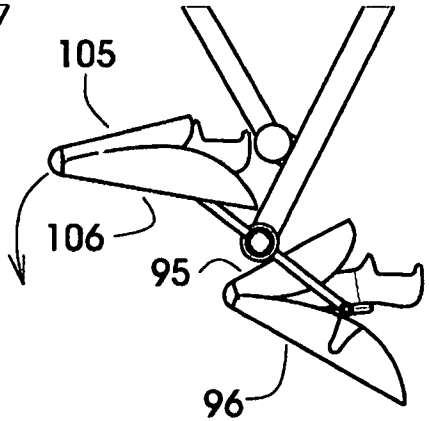

In referring to FIG. 5D, 5E, 5F, when the end user begins to pedal forward the right upper wing 95 and right lower wing 96 begin to close and create a streamlined shape that allows the water to flow over it. At the same time the left upper wing 105 and the left lower wing 106 are heading on the back stroke toward the rear of the cycle and begin to open as the water forces the upper left wing 105 upward and the left lower wing 106 downward to open up creating a cup shape. As the pedaling process takes place the right wing set 95, 96, closes when moving toward the front allowing water to flow over it as the left wing set 105, 106, opens catching the water creating forward propulsion for the cycle. When the left wing set 105, 106, begins to reach the apex as shown from FIGS. 5G to 5H and change direction to moving forward, the left wing set 105, 106, becomes the closed shape as shown in FIG. 5H allowing water to flow around it as the right wing set 95, 96, now becomes the open set catching the water and creating forward thrust. This left wing set 105, 106, catching the water and then the right wing set 95, 96, catching the water is very similar to the operation of a normal bicycle except that the catching of the water creates the forward motion.

Referring to FIG. 8, the user-specific buoyancy adjustment 150 consists of a basic flotation support that can be of any shape or size as part of the fourth embodiment 18 of Aquatic Equilibrium Cycle. The handlebar flotation support 152 and the seat flotation support 153 are of a design that increases directional control as well as incorporates specific buoyancy control. Notice that the design of this rear flotation support 153 incorporates a large rudder 153*a* and equally large rudder 152*a* on the front flotation support 152. This is designed to increase the control over a specific direction of travel and be more in alignment with a bike like experience. The front flotation support also incorporates a clockwise counterclockwise steering to augment the water bike experience.

To incorporate the User Specific Buoyancy Adjustment, the flotation supports 152, 153 must be of a hollow nature such that the units stay sealed when the end user wants them to be sealed and open to allow air or water in or out. On the outside surface of each flotation support 152, 153 there is a flow (155), no-flow (156) device, that allows for a fluid medium, such as water or air to enter the flotation support and then the ability to seal the flotation support to prevent any more water or air from re-entering it. This opening and closing to allow water in or air out or air in and water out can be utilized over and over again as needed. This device can be in the form of a screw on cap with ability to seal or a valve that can be opened for flow 155 and closed for no flow 156. The valve can be similar to that used in a diving suit to allow for real-time adjustment of flotation by a user while on the cycle by pushing a button to allow for reduced buoyancy or pumped up like a bulb to allow for increased flotation to raise the end user further out of the water. The device can also be of a simpler nature that can be set at initial use when first getting into a body of water to set the flotation for their personal use. The previous flotation designs shown in FIG. 1, the front flotation support 30 and the rear flotation support 50 and FIG. 2A, the real-time, user-adjustable front flotation support 240 and the self adjusting rear flotation support 260 and FIGS. 6A and 6B, the real-time, user-adjustable handlebar flotation support 120 and FIGS. 7A and 7B, the self adjusting split seat flotation support 140 can all be designed with the user-specific buoyancy adjustment built into them. This embodiment is shown with a very large valve, this it to accommodate easy cleaning of the inside of the flotation supports as well as simply demonstrate the implementation of this feature.

Referring to FIG. 8, the flow (155) no-flow (156) device would be opened for flow 155, before entering the water to allow all water out of the handlebar flotation support 152 and the seat flotation support 153 of the fourth embodiment 18. The flow (155) no-flow (156) device, would be sealed by screwing it back onto the handlebar flotation support 152 or the seat flotation support 153, before placing the fourth embodiment 18 into the water. Upon entering the water an end user would have an assistant partially open the flow (155) no-flow (156) device on the handlebar flotation support 152 and the seat flotation support 153 at the same time slowly allowing some water into the supports 152, 153 until the water level is such that the water line is between the end user's elbow and shoulder as shown in FIG. 3. At this point the flow (155) no-flow (156) device on each support 152, 153 would be closed to create a seal resulting in the proper height out of the water for a personal setting for that particular end user.

If the flow (155) no-flow (156) device had a real-time adjustment on it, the end user could adjust specifically the buoyancy while using the device. This could be accomplished by a rubber bulb, similar as used when taking blood pressure. As each bulb for each support was squeezed it would force water out of the support 152, 153. This would cause the flotation support 152, 153 to increase in buoyancy raising the cycle further out of the water. When the bulb was allowed to release air, water would begin to fill the flotation supports 152, 153 causing the cycle to sink in the water. This process would allow the user to create an ongoing unique user-specific experience. This process would also provide a simple ability to set the flotation as a new user enters the water.

As a final additional to this embodiment, the flotation height could be automated by built in sensors that would force air into or out of the flotation supports by way of a sealed battery powered compressor and water level sensors built into the cycle. This could allow for automatic height adjustment for each user as they use the device or could be pre-programmed to create a challenge for the end user as they ride the cycle making them have to maintain balance while the buoyancy is being automatically changed for different body workouts, sports competitions, or rehabilitation workouts.

ADVANTAGES

From the description above a number of advantages of the Aquatic Equilibrium Cycle become evident:

a.) It is simple. Since the floatation supports keep a person afloat but are fully/partially submerged, it forces the end user to maintain balance while pedaling which creates a challenge that is both fun and supportive of coordination and muscle building or rehabilitating while in use.

b.) A person of any age can master its use but still be continually challenged by modification of pedal resistance as well as using it in different bodies of water, such as a pool, a lake, or the ocean or creating a greater challenge with automated pre-programmed buoyancy control.

c.) The unit is designed to be compact when not in use for easy transport to any body of water or for storage.

d.) The device provides for a fun new sport in racing competition as well being a challenge to master.

e.) The end user is provided a low impact workout that allows for motion and exercise at the same time.

f.) The Aquatic Equilibrium Cycle allows end users to:

a. Exercise as if bike riding any time of year, even in the winter, at any indoor pool.

b. Get a full body workout due to the need to maintain equilibrium while in use as well as pedaling to develop leg muscles and coordination.

c. Work in coordination with a Physical Therapist to rebuild muscle damage in a low impact manner.

d. Compete in a new sport where balance and the unique pedal resistance system simulates an octopus' motion to create movement that forces the end user to be fast, powerful, coordinated and balanced, depending on how far the wings of the octopus like device are allowed to open.

e. Provide steering and maneuverability emulating as close as possible the pluses of a land bicycle in a water environment. Accordingly the reader will see that the Aquatic Equilibrium Cycle of this invention can be used to simply, safely, quickly and easily afford an end user the ability to exercise in the water, perform physical therapy or compete in a motive water sport while being partially submerged or submerged just under the surface of the water. The device has numerous advantages including:

a. Easy deployment in any body of water for quick exercise or fun.

b. The ability to adjust pedal resistance before placing in the water or after, by use of an on the fly resistance adjustment.

c. The distance of the user handle bars from the seat is adjustable with the option of locking it while in use.

d. The device is so similar in use to a real land bicycle that there will be little time in adaptation for its first time use.

e. Elimination of inflatable floatation or modification kits for water exercise.

f. The opportunity of losing balance or losing control is still possible which makes the unit challenging to ride and simulates the learning many had to experience when first riding a land bicycle.

g. Fun to use and allows for exercise and therapy and a new sport all in one unit.

h. A compact device that is easy to store and transport and deploy.

i. The ability to change buoyancy to accommodate different users' body density and personal preference.

j. The option of automated buoyancy adjustment that allows the unit to be pre-programmed to automatically adjust to new users or programmed to provide an exciting challenge, an exercise routine or a rehabilitation program for recovery.

Although the description above contains many specifics, these should not be construed as limiting the scope of the invention but as merely providing illustrations of some of the presently preferred embodiments of this invention. For example, the scoop shape of the octopus pedal design can be of a different shape or material to allow for a greater opening; the semi-arc floatation support can be of a different shape to help facilitate a more ergonomic result or to promote an increase or decrease in buoyancy; the handlebars and the floatation thereof can be made of different materials or shape to help facilitate a simpler method for lift while forcing a need to maintain equilibrium without providing too much stability; the fold up design of the unit could be modified to be a snap together unit or the hinge point could be in a different place to allow for an even simpler method to create a compact design; the unit could even be designed to be made of one part that snaps together with other parts to create a serpentine effect creating the overall shape for the unit that is easy to pull apart and change configurations. As another alternative the device could be configured with a real time water flotation compensation for the end user to change the flotation on the fly. This alternative could incorporate a built in air compressor for adding or taking air from inside the flotation supports allowing for the ability to create a pre-programmed bucking bronco simulation in the water for competition.

Described herein are the preferred embodiments; however one skilled in the art that pertains to this invention will understand that there are equivalent alternative embodiments that could easily be developed.

We claim:

1. An aquatic equilibrium cycle comprising:

a) vertically oriented frame adapted to be straddled by a user wherein the vertically oriented frame comprises a first straight frame member sloping forward from an upper most portion to a lowermost portion and a second frame member attached to the first straight frame member near the lowermost portion of the first straight frame member by a hinge, the first and second frame members forming a V, the hinge permitting real-time adjustment of a distance between the first and second frame members during use;

b) a forward floatation support attached to the vertically oriented frame designed to provide a first upward buoyancy force for partially supporting a user's body weight and comprising a handlebar and a vertically extending rudder which provides enhanced lateral stability;

c) a rear floatation support separate from and disconnected from the forward floatation support and attached to the vertically oriented frame designed to provide a second upward buoyancy force partially supporting a user's body weight and comprising a seat and includes a vertically extending rudder which provides enhanced lateral stability;

d) an adjustment means for either the forward or rear floatation supports permitting variation in a level of buoyancy provided by the floatation support by altering a ratio of air and water captured internally in the forward and rear floatation supports; and e) a pedal assembly secured to a lower end of the V-shaped frame for providing a user exercise when the aquatic equilibrium cycle is placed in water of sufficient depth to afford operational clearance for the pedal assembly, the pedal assembly comprising two pedals, each having a clam-shell structure including a first wing and a second wing pivotally connected at a front end of each the wing whereby the pedal assembly opens on a rearward stroke capturing a quantity of water and closes on a forward stroke to minimize resistance to movement and expel the captured quantity of water providing octopus-type propulsion, whereby the forward and rear floatation supports collectively provide sufficient buoyancy force to maintain the user's head above water, but insufficient collective buoyancy force to elevate a majority of the aquatic equilibrium cycle above a surface of the water.

* * * * *